United States Patent [19]

Kawai et al.

[11] Patent Number: 4,884,254

[45] Date of Patent: Nov. 28, 1989

[54] TIME DISPLAY DEVICE

[75] Inventors: Shoichi Kawai, Sangenya-nishi; Masayuki Konishi, Nara; Chieji Katoh, Yamatokoriyama, all of Japan

[73] Assignee: Sharp Kabushiki Kaisha, Osaka, Japan

[21] Appl. No.: 289,828

[22] Filed: Dec. 27, 1988

[30] Foreign Application Priority Data

Dec. 28, 1987 [JP] Japan ..... 62-200324

[51] Int. Cl.[4] ..... G04B 19/22

[52] U.S. Cl. ..... 368/21

[58] Field of Search ..... 368/21–24

[56] References Cited

U.S. PATENT DOCUMENTS 4,133,170 1/1979 Kashio ..... 368/21
4,313,180 1/1982 Yoshida ..... 368/22
4,681,460 7/1987 Mishimura ..... 368/21

FOREIGN PATENT DOCUMENTS 61-110081 5/1986 Japan .
62-88988 4/1987 Japan .
62-267689 11/1987 Japan .

*Primary Examiner*—Vit W. Miska
*Attorney, Agent, or Firm*—Birch, Stewart Kolasch & Birch

[57] ABSTRACT

A time display device comprising: a key input unit; a display unit; a clock unit for timing the standard time; a city name memory unit storing city names of three figures; a time difference memory unit storing the time differences of individual cities; a city name call unit for displaying the city names in a listed form in the display unit; a city name selection unit for selecting one city name from those listed; a city time calculation unit for determining the time of the selected city name by calculations of the standard time and the time difference and for outputting the determined time to the display unit; and city name rearrangement unit for enabling a city name of high selection frequency to be preferentially called by storing the selected city name in the head of the city name memory unit.

5 Claims, 6 Drawing Sheets

TIME DISPLAY DEVICE

BACKGROUND OF THE INVENTION

1. Field of the Invention

The present invention relates to a time display device which is enabled to display the time of a selected city digitally in a display screen by selecting the cities of the world arbitrarily.

2. Description of the Prior Art

In the prior art, the time display device of this kind is known as a world clock display function built in a portable electronic calculator and is constructed to display the time of a desired city selected from the present major cities of the world.

In the above-specified time display device, however, the number of selectable cities is limited to several. As a result, the city having its time desired to be displayed may frequently fail to be included in the range of selection, thus raising a problem of lack of wide use. Even if the city has a high call frequency, on the other hand, its name has to be selected each time its time is to be displayed, thus raising another problem of troublesome operations. The conventional time display device for selecting a desired city from the limited number of major cities to display the time is exemplified by the "world clocks", as disclosed in Japanese Patent Laid-Open Nos. 61-110081, 62-88988 and 62-267689.

SUMMARY OF THE INVENTION

In accordance with the present invention, a time display device is provided which comprises input means having a variety of input keys and instruction keys; timing means for timing and outputting a standard time; city name memory means for storing city names of three figures; time difference memory means for storing the time difference of individual cities from the standard time; display means for displaying various pieces of information; city name call means for calling the city names which are stored in said city name memory means, from the head and at a unit of a predetermined number, when an instruction key for calling the city name is operated, and for displaying them in a listed form in said display means; city name selection means for selecting a desired city from the listed city names when an instruction key for selecting the city name is operated; city time calculation means for outputting the time of the selected city and outputting the time to said display means by calling the time difference of the selected city name, when selected, from said time difference memory means and by adding the called time difference to the standard time outputted from said timing means; and city name as the first listed city rearrangement means for storing the selected city name in the head of said city name memory means.

The standard time in the present invention is that which is initially set at New York to indicate the difference between the time of New York and the time of each city of the world. However, the city of the standard time can be changed to another city.

The city name memory means may preferably be constructed of a memory having a capacity capable of storing city names of three figures, e.g., more than 200 city names. The time difference memory means may preferably be constructed of a memory for storing the time differences of the same number as that of the city names. On the other hand, the display means may preferably be comprised of a liquid crystal display capable of selectively displaying either the list of the city names or the time of the selected city.

The relationship among the functions of the above-mentioned means is shown in FIG. 1.

The city name call means 6 calls the city names from the city name memory means 3 and displays them in the list when the time display is instructed by the input means 1. When the name of the city having the time to be displayed is instructed by the instruction key from the city names listed, the city name selection means 7 selects the city name instructed and outputs the selected city name to both the city time calculation means 8 and the city name rearrangement means 9. Then, the city time calculation means 8 determines the time of the selected city name by calling up the time difference corresponding to the selected city name from the time difference memory means 4 and by adding it to the time outputted from the timing means 2 and outputs the determined time to the display means 5.

On the other hand, the city name rearrangement means 9 stores the selected city name as the first listed city in the head of the city name memory means 3.

Hence, the present invention stores a large number of city names and can display the time of a desired city selectively and conveniently. Since, moreover, the selected city name is stored again as the first listed city in the head of a high calling priority of the city name memory means, that is, since the city name of a higher selection frequency is preferentially called, the call of the time of a city of a specific zone can be accomplished by very simple operations. Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DESCRIPTION OF THE PREFERRED EMBODIMENTS

Figure 1:
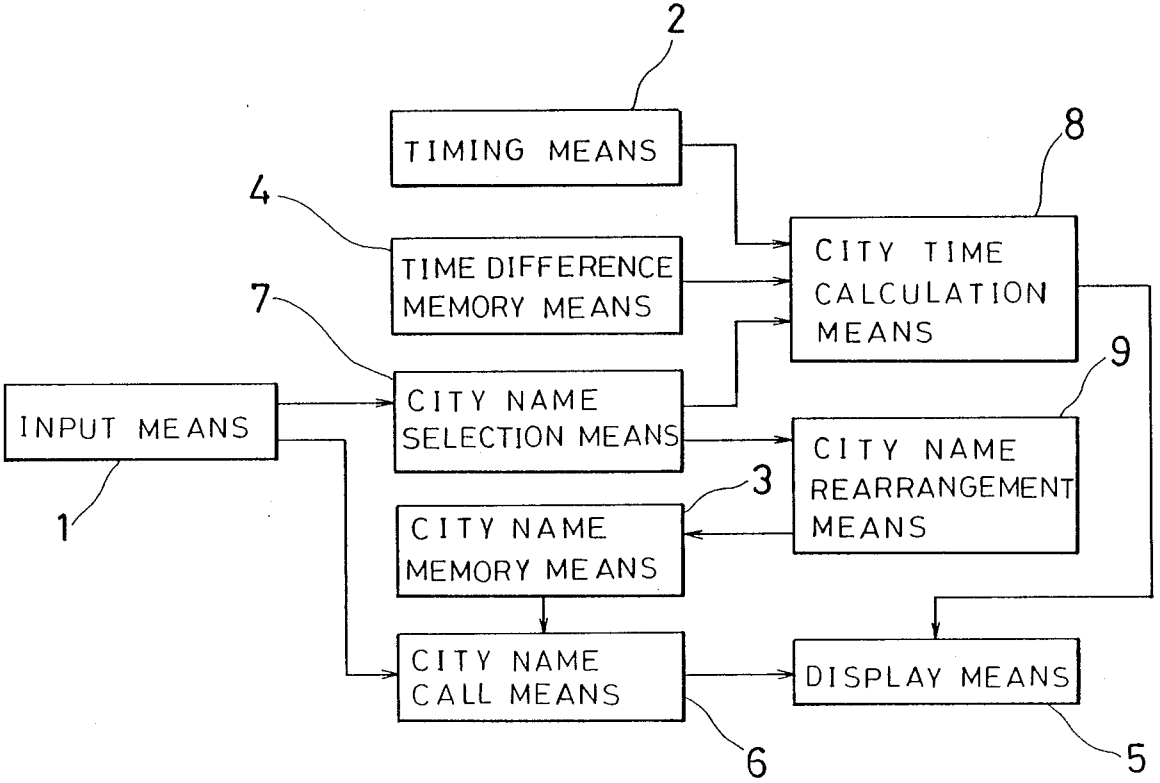
FIG. 1 is a block diagram showing the structure of the present invention.
Figure 2:
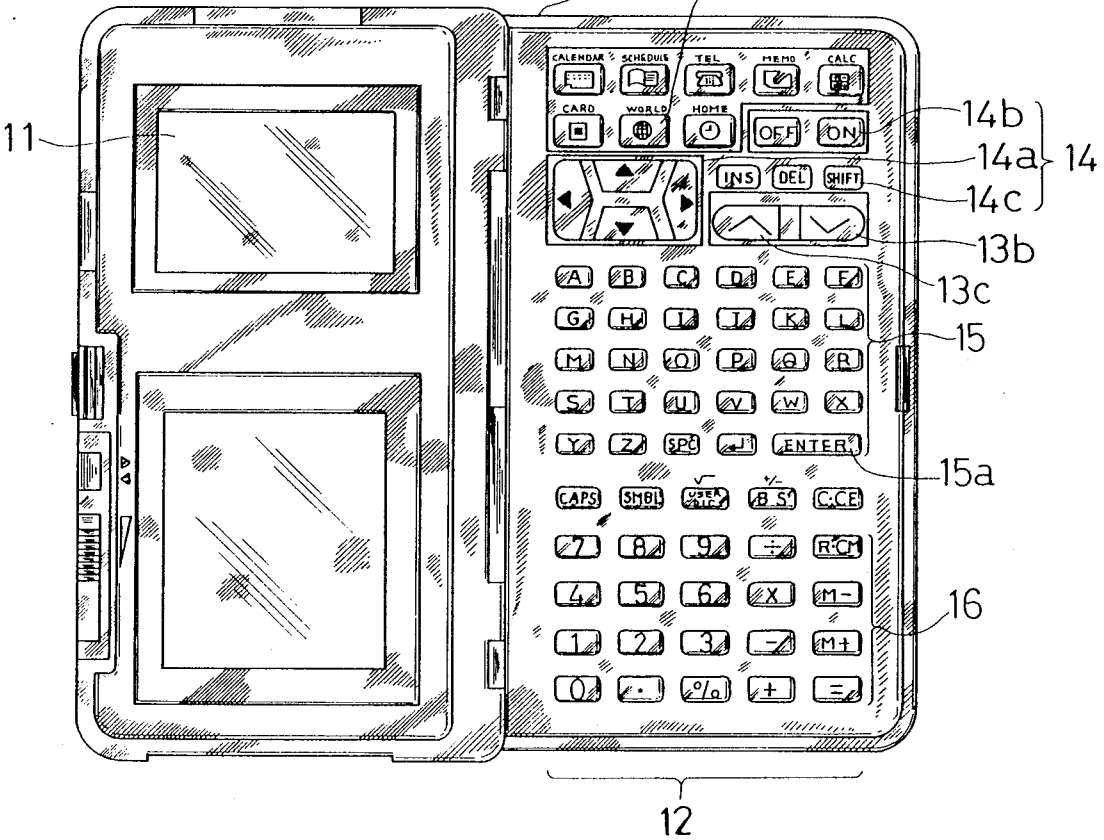
FIG. 2 is a top plan view showing an embodiment of the present invention.
Figure 3:
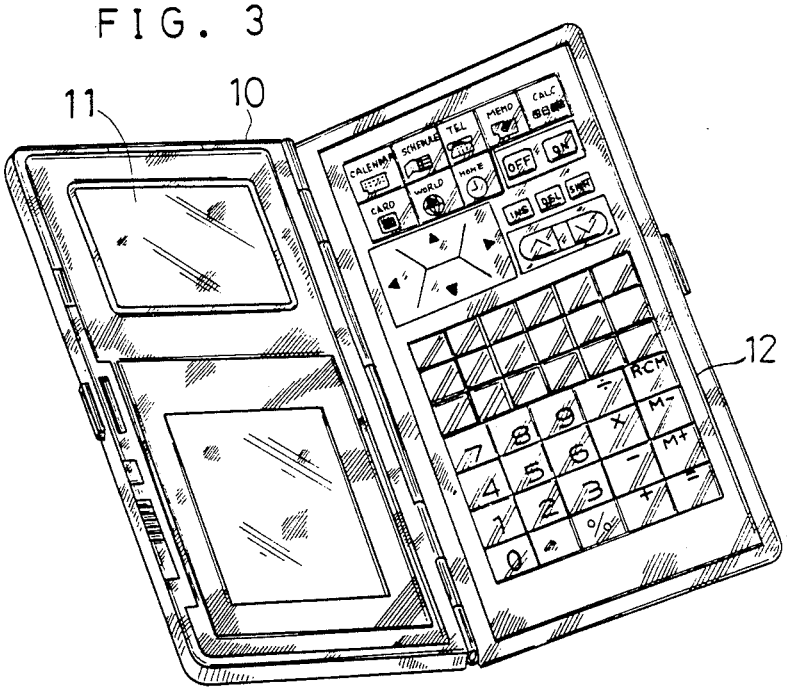
FIG. 3 is a perspective view showing the external appearance of FIG. 2.

FIG. 2 is a top plan view showing a multi-function electronic calculator according to one embodiment of the time display device of the present invention, and FIG. 3 is a perspective view showing the external appearance of the same. In these two Figures, reference 10 designates the body of the multi-function electronic calculator, which is equipped at an upper portion of its lefthand side with a display unit 11 acting as display means for displaying not only the times relating to the present invention but also the results of numerical calculations or the like. This display unit 11 is made of an LCD having a dot matrix structure, for example. Numeral 12 designates a key input unit composed of membrane switches, for example, and acting as input means. The key input unit 12 is constructed mainly of (later-described) time display selecting keys for selecting the time display functions, operation keys 14, information input keys 15 and calculation keys 16.

The time display selection keys are composed of a [world] key 13*a* for starting a program for displaying the times of the cities of the world, a [V] key 13*b* for scrolling (or calling) the city names of individual countries listed in the display unit 11 in the forward direction, and a [Λ] key 13*c* for scrolling the city names backward.

The operation keys 14 are composed of four keys (i.e., [▲], [▼], [◀] and [▶] keys) for moving the position of the cursor displayed in the display unit 11 upward, downward, leftward and rightward, respectively, on/off keys (i.e., [ON] and [OFF] keys) 14*b* for turning on and off the power to be supplied to the body 10, and a [SHIFT] key 14*c*. The information input keys 15 are composed mainly of alphabetical letter input keys and an [ENTER] keys 15*a* for executing the inputs. The calculation keys 16 are composed of register keys for four arithmetical operations and operation keys.

On the other hand, the body 10 is equipped therein with a CPU (Central Processing Unit) for controlling, the display unit 11, the input/output of the key input unit 12 and the real time clock for timing (which will be shortly referred to as the "RTC").

Figure 4:
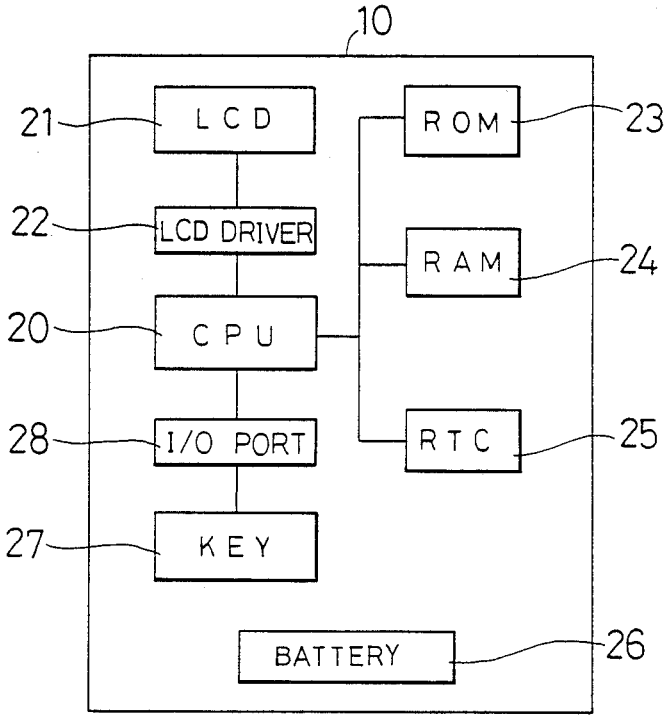
FIG. 4 is a block diagram showing the structure of the embodiment of the present invention.

FIG. 4 is a block diagram showing the structure of the multi-function electronic calculator. In FIG. 4, reference numeral 20 designates a CPU acting as the city name call means, the city name selection means, the city time calculation means and the city name rearrangement means for providing control of operation of the inputs and outputs of the multi-function electronic calculator as a whole. Numeral 21 designates an LCD which is driven by a driver (i.e., LCD DRIVER) 22 on the basis of a control signal outputted from the CPU 20 for displaying the time and so on. Numeral 23 designates a ROM built in the body 10 and acting as the time difference memory means and the city name memory means. The ROM 23 stores the operation control program of the CPU 20 of the multi-function electronic calculator and the time differences between the individual city times and the standard time. The ROM 23 stores the data of 212 city names (of 141 countries). Numeral 24 designates a RAM for temporarily storing the data to be used in the above-specified program. Numeral 25 designates an RTC acting as the timing means for counting the hours, minutes and seconds automatically. The counted contents can be read and written by the CPU 20. Numeral 26 designates a battery for energizing the multi-function electronic calculator. Numerals 27 and 28 designate a key input unit and an I/O port, respectively.

Figure 5:
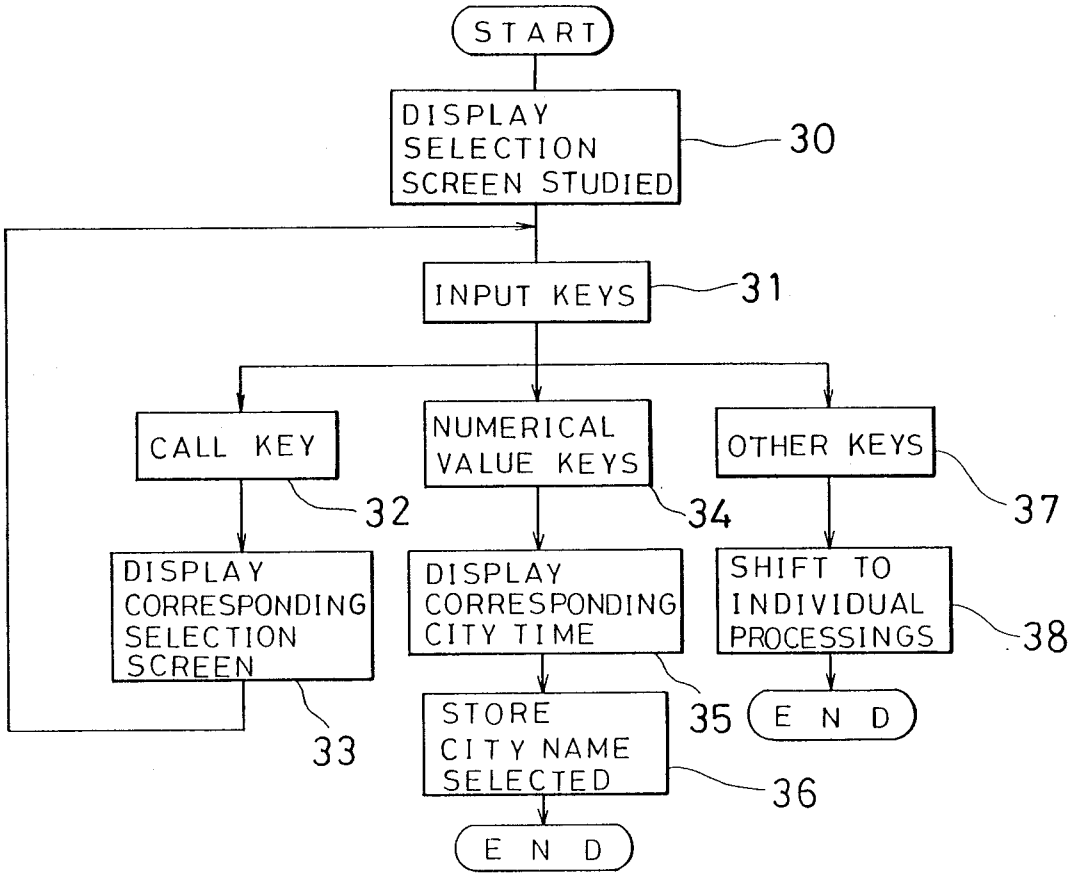
FIG. 5 is a flow chart for explaining the operations of the embodiment of the present invention.
Figure 6A:
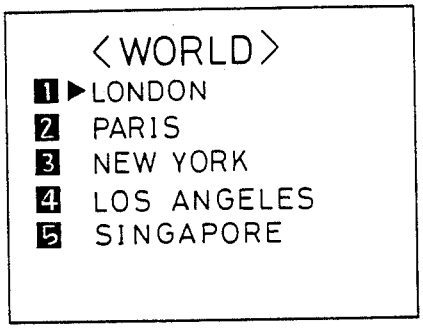
FIGS. 6*a* to 6*d* are diagrams showing display examples of the embodiment of the present invention.
Figure 6B:
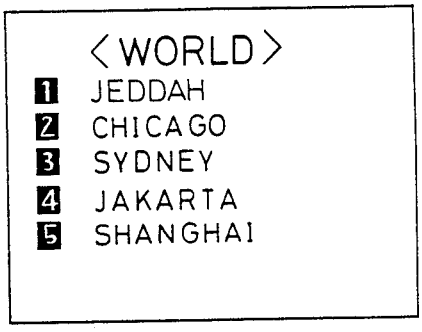
Figure 6C:
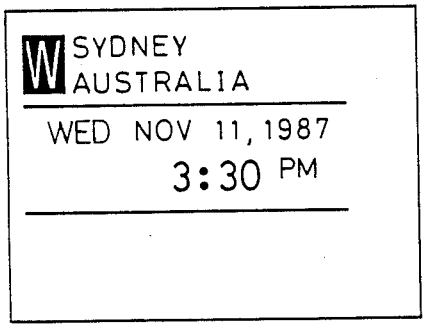
Figure 6D:
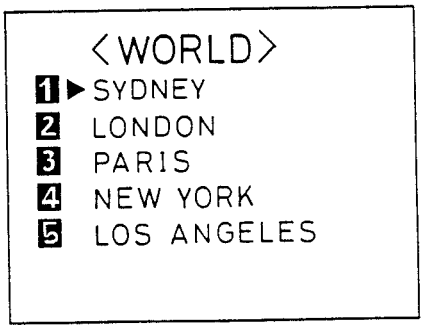

In the multi-function electronic calculator having the structure thus far described, the operations of one embodiment will be described with reference to the flow chart shown in FIG. 5. The [SHIFT] key 14*c* is pressed, and the [WORLD] key 13*a* is pressed to set a city name selection mode. This setting allows an arbitrary city name to be selected from the city names of the individual zones of the world. By this setting, moreover, five city names stored in a specified region of the RAM 24 are displayed in the listed form in the display unit 11. This display state is shown in FIG. 6*a*. The aforementioned specific region of the RAM 24 is set (at Step 30) with the data of five city names selected previously such that the most recently selected ones are in upper positions. In case the multi-function electronic calculator is reset, the initial data (of city names) stored in its ROM 23 are set. If, at this setting, the desired city is not present in the city names displayed in the display unit 11, the call key 13*b* or 13*c* is operated (at Step 32) to display another city name selection screen (at Step 33) thereby to retrieve the desired city name. FIG. 6*b* shows a display example in case a city absent from the selection screen of FIG. 6*a* such as "SYDNEY" is retrieved at the aforementioned Step. Incidentally, the individual city names are arranged in the alphabetical order of the country names so that the cities of a country beginning with an "A" can be quickly retrieved if the [A] key of the information input keys 15 is pushed, for example. If the desired city name is present in the displayed city names, any of the numeral keys [1] to [5] of the calculation keys 16 is pushed (at Step 34) to select the city name. The present time of the selected city is obtained by the arithmetical processing of the CPU 20 based on the correlation data (i.e., the time difference) from the standard time stored in the ROM 23. The result is displayed (at Step 35) as the present time of the corresponding city in the display unit 11. FIG. 6*c* shows a display example wherein numerical key [3] is pushed to select "SYDNEY". After the end of the display of the present time of "SIDNEY", the data of the city name selected is stored (at Step 36) in the specific region of the RAM 24. At this time, the city name data already existing in the RAM 24 are transferred in lower ranks than the new city name data "SYDNEY". In the event that the city name selection screen is set at the next time, the initial selection display of the city names is headed by "SYDNEY" in the list, as shown in FIG. 6*d*. Incidentally, if the key input at Step 31 is neither the cursor key nor the numerical keys, the processings shift (at Steps 37–38) to those other than the time display.

Figure 7A:
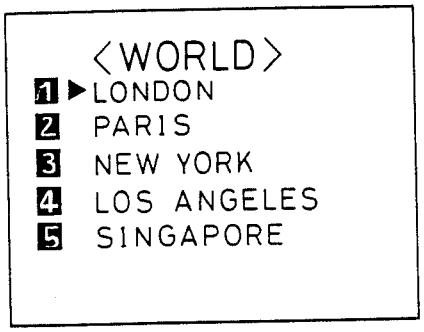
FIGS. 7*a* to 7*e* are diagrams showing display examples of daylight saving times of the embodiment of the present invention.
Figure 7B:
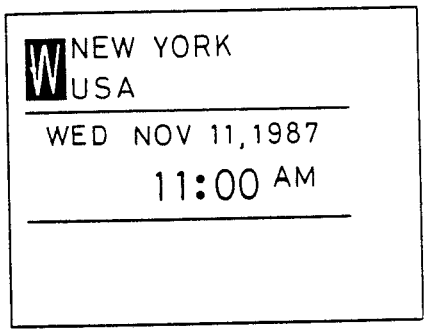
Figure 7C:
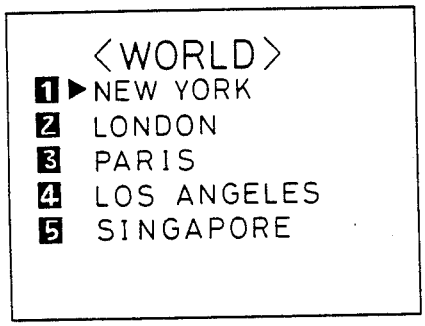
Figure 7D:
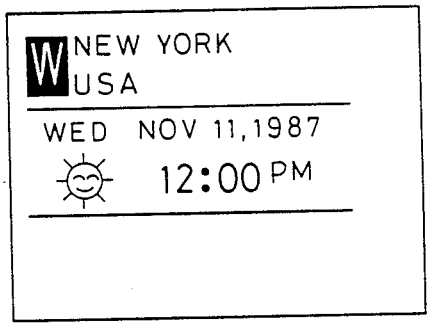
Figure 7E:
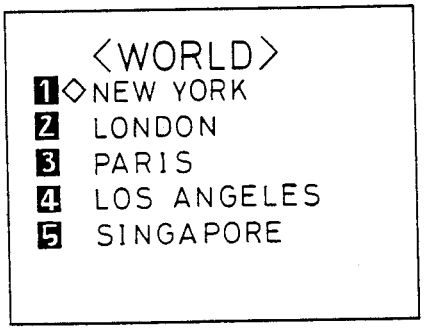

Next, the operations of the daylight saving time adopted in many countries such as the U.S.A, England or Italy will be described in the following additional embodiment [SHIFT] key 14*c* and then the [WORLD] key 13*a* are pushed to invite the selection setting mode for setting the city having its time to be displayed. An example of this display is shown in FIG. 7*a*. FIG. 7*b* shows a display example wherein numerical key [3] is pushed to select "NEW YORK", and FIG. 7*c* shows the display after the selection has been set. In this selection set mode, a desired city name is searched for by procedures similar to the foregoing ones. In the description of the foregoing embodiment, the numerical key is pushed to select the desired city name. In case the daylight saving time is to be set, on the contrary, the numerical key is depressed, after the [SHIFT] key 14*c* has been operated, to select and set the cities having the daylight saving time. FIG. 7*d* shows an example wherein numerical key [3] is pushed to select the daylight saving time of "NEW YORK" after the SHIFT key 14c has been operated, and FIG. *7e* shows a display after the selection setting. As apparent from the comparison with FIG. *7b* (without any display of the daylight saving time), the ☼ mark is displayed in FIG. *7d* whereas " ◇ " mark is displayed in FIG. *7e* so that the daylight saving time is clearly and effectively displayed. This daylight saving time can be obtained by the calculations of the CPU 20 on the basis of the correlation coefficient (or shift time) stored in the ROM 23.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A time display device comprising:

input means having a variety of input keys and instruction keys;

timing means for timing and outputting a standard time;

city name memory means for storing city names of three figures;

time difference memory means for storing the time difference of individual cities from the standard time;

display means for displaying various pieces of information;

city name call means for calling a predetermined number of the most recently called city names which are stored in said city name memory means when an instruction key for calling the city name is operated, and for displaying them in a listed form in said display means;

city name selection means for selecting a desired one from the listed city names when an instruction key for selecting the city name is operated;

city time calculation means for outputting the time of the selected city and outputting the time to said display means by calling the time difference of the selected city name, when selected, from said time difference memory means and by adding the called time difference to the standard time outputted from said timing means; and city name rearrangement means for storing the selected city name as the first listed city of said city name memory means.

2. A time display device according to claim 1, wherein said city name memory means in a ROM storing city names of three figures such as 200 or more city names.

3. A time display device according to claim 1, wherein said time difference memory means is a ROM storing the same number of time differences of the individual cities as that of the city names stored in said city name memory means.

4. A time display device according to claim 1, wherein said display means is a liquid crystal display device for selectively displaying any one of the city name list, the time of the selected city and the daylight saving time of the selected city together with a daylight saving time mark.

5. A time display device according to claim 1, wherein said input means is comprised of membrane switches, input keys and instruction keys.

* * * * *